US010978030B2

(12) United States Patent
Schipani

(10) Patent No.: US 10,978,030 B2
(45) Date of Patent: Apr. 13, 2021

(54) BRIDGED KEYWORK MECHANISM FOR A SAXOPHONE

(71) Applicant: EASTMAN MUSIC COMPANY, Pomona, CA (US)

(72) Inventor: David Schipani, West Roxbury, MA (US)

(73) Assignee: EASTMAN MUSIC COMPANY, Pomona, CA (US)

( * ) Notice: Subject to any disclaimer, the term of this patent is extended or adjusted under 35 U.S.C. 154(b) by 0 days.

(21) Appl. No.: 16/832,198

(22) Filed: Mar. 27, 2020

(65) Prior Publication Data

US 2020/0312284 A1 Oct. 1, 2020

Related U.S. Application Data

(60) Provisional application No. 62/825,550, filed on Mar. 28, 2019.

(51) Int. Cl.
*G10D 7/08* (2006.01)
*G10D 9/047* (2020.01)

(52) U.S. Cl.
CPC ..... *G10D 9/047* (2020.02); *G10D 7/08* (2013.01)

(58) Field of Classification Search
CPC ..... G10D 9/047; G10D 7/08
See application file for complete search history.

(56) References Cited

U.S. PATENT DOCUMENTS 2,522,424 A * 9/1950 Arnold ..... G10D 7/08 84/385 R

FOREIGN PATENT DOCUMENTS

GB 002125605 A * 3/1984

* cited by examiner

*Primary Examiner* — Kimberly R Lockett
(74) *Attorney, Agent, or Firm* — Risso I.P.

(57) ABSTRACT

Described is a bridged keywork mechanism for a saxophone that can be implemented on each of the left and right-hand sides of the saxophone. Each bridged keywork mechanism includes a first key having a first tail terminating in a first kicker. The first key is pivotally connected with the saxophone to pivot about a first axis. A first bridge is pivotally connected with the saxophone to similarly pivot about the first axis. The first bridge also includes a first bridge beam. A second key is attached with the first bridge. Further, one or more first plates project outward from the first bridge beam. The first key is pivotally attached with the saxophone such that the first kicker resides below the one or more first plates. In operation, activating the first key causes the first kicker to lift the first bridge beam and thereby activate the second key.

11 Claims, 9 Drawing Sheets

102

104

BRIDGED KEYWORK MECHANISM FOR A SAXOPHONE

CROSS-REFERENCE TO RELATED APPLICATIONS

This is a non-provisional application of U.S. Provisional Application No. 62/825,550, filed on Mar. 28, 2019, the entirety of which is incorporated herein by reference.

BACKGROUND OF THE INVENTION

(1) Field of Invention

The present invention relates a saxophone mechanism and, more specifically, to a bridged keywork mechanism with plates and kickers as applied to a saxophone.

(2) Description of Related Art

Saxophones are considered woodwind musical instruments that generate sound based on blowing in a mouthpiece. In use, a reed within the mouthpiece vibrates and the sound is amplified by the resonance of the conical body. The pitch or sound can be changed using a number of buttons that operate mechanisms. These mechanisms include keys that cover a corresponding tone holes formed along the conical body. Use of the buttons allow different combinations of holes to be covered/uncovered (via the keys), allowing the saxophone to play a wide acoustic range. Saxophones typically include bridged keywork that includes a button connected with multiple keys to simultaneously operate several keys using the single button. While somewhat operable, the existing saxophone bridge mechanisms suffer from a variety of shortcomings.

Another woodwind instrument also often includes a bridge mechanism. Specifically, flutes are often created that include bridgework to allow a user to operate several keys simultaneously. While generally operable, existing flute bridgework also has several shortcomings and cannot be translated to the shape and function of a saxophone.

Thus, a continuing need exists for improved a keywork mechanism on a saxophone that improves upon the shortcomings of the prior art.

SUMMARY OF INVENTION

A primary objective of the present invention is to provide an improved bridged key work mechanism for the entire saxophone family that that will overcome the shortcomings of prior saxophone mechanisms. Specifically, this disclosure provides a bridged keywork mechanism for a saxophone with a first key having a first tail terminating in a first kicker. The first key is pivotally connected with the saxophone to pivot about a first axis. A first bridge is included having a first bridge beam spanning a length of the first bridge. The first bridge is pivotally connected with the saxophone to pivot about the first axis. Further, a second key is attached with the first bridge. Importantly, one or more first plates project outward from the first bridge beam. The first key is pivotally attached with the saxophone such that the first kicker resides below the one or more first plates. Thus, activating the first key causes the first kicker to lift the first bridge beam and thereby activate the second key.

In another aspect, the first bridge beam has a second axis passing through the first bridge beam such that the first axis and the second axis are skew with respect to one another.

In yet another aspect, the one or more first plates project from the first bridge beam such that each plate in the one or more first plates lays in a distinct plane.

In another aspect, a set of adjustment pads is connected with the first kicker to sandwich the first kicker therebetween.

Further, the first key, first bridge, and second key collectively form a right-hand bridged keywork mechanism.

In another aspect, this disclosure provides a third key having a third tail terminating in a third kicker, the third key being pivotally connected with the saxophone; a second bridge having a second bridge beam spanning a length of the second bridge, the second bridge being pivotally connected with the saxophone; a fourth key attached with the second bridge; and one or more second plates projecting outward from the second bridge beam, wherein the third key is pivotally attached with the saxophone such that the third kicker resides below the one or more second plates. Thus, activating the third key causes the third kicker to lift the second bridge beam and thereby activate the fourth key.

In yet another aspect, the third key, second bridge, and fourth key collectively form a left-hand bridged keywork mechanism. Each of the right-hand bridged mechanism and left-hand bridged keywork mechanism are connected with the saxophone such that they are offset from one another around the body of the saxophone.

Given the features as described herein, an advantage of the present invention is to increase the stability of adjustment between keys within the bridged sections by the introduction of large top plates attached to the bridges and large kickers attached to the keys. This results in an increased surface area at the point of contact between keys. This departs from conventional saxophone key designs and concepts and is original to this invention.

A further advantage of the present invention is to make the saxophone mechanism faster by exploiting the mechanical advantages of larger back plates and kickers. The larger plates and kickers sit further away from the fulcrum point of the key, increasing the distance between the point of load and the point of effort as compared to conventional saxophone design, thereby rendering the key movement easier for the player.

Another advantage of the present invention is to reduce key to key contact noise by increasing the surface area of the adjustment contact points by the design of the larger top plates and larger kickers.

A further benefit of the larger top plates and kickers is to increase the speed at which the pad makes positive contact with the sealing surface of the tone hole within bridged sections by providing a larger, more positive, contact interface between the keys within bridged sections as they relate to each other in operation.

Another benefit of the present invention is to simplify the final assembly of the saxophone by increasing the surface area of the adjustment material as it is attached to the larger top plates and kickers. This larger area allows the technician easier access to the increased surface areas of the compressed felt adjustment materials, thereby rendering the adjustment procedure less difficult and more stable (i.e., will remain in adjustment longer).

A further advantage of the present invention is to introduce the use of compressed felt as a superior adjustment material between the larger top plates and the larger kickers, as well as between the kickers as they contact the saxophone body.

Finally, the present invention also includes a method for forming and using the mechanism as described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates a saxophone mechanism and, more specifically, to a bridged keywork mechanism with plates and kickers as applied to a saxophone. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
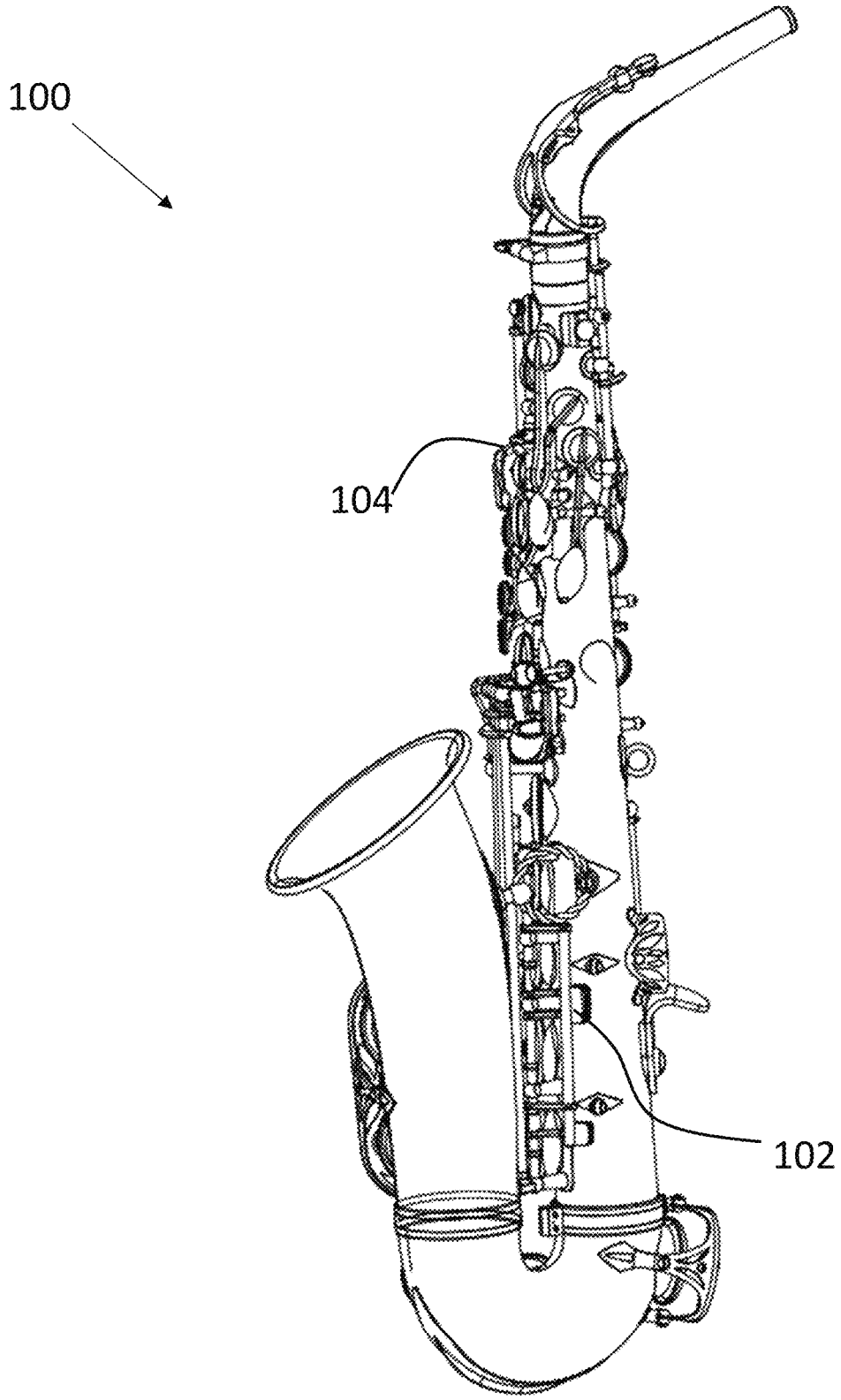
FIG. 1 is an illustration of a saxophone according to various aspects of the present invention.

As shown in FIG. 1, the present disclosure is directed to a bridged keywork mechanism for a saxophone 100 that improves upon the responsiveness and functionality of existing bridge mechanism. Specifically, the bridged keywork mechanism includes both a right-hand bridged keywork mechanism 102 and a left-hand bridged keywork mechanism 104, each with improved features that provide the benefits of stability, quickness, quietness and ease of construction when this system of kickers and plates is applied to the saxophone. These aspects are described in further detail below.

Figure 2A:
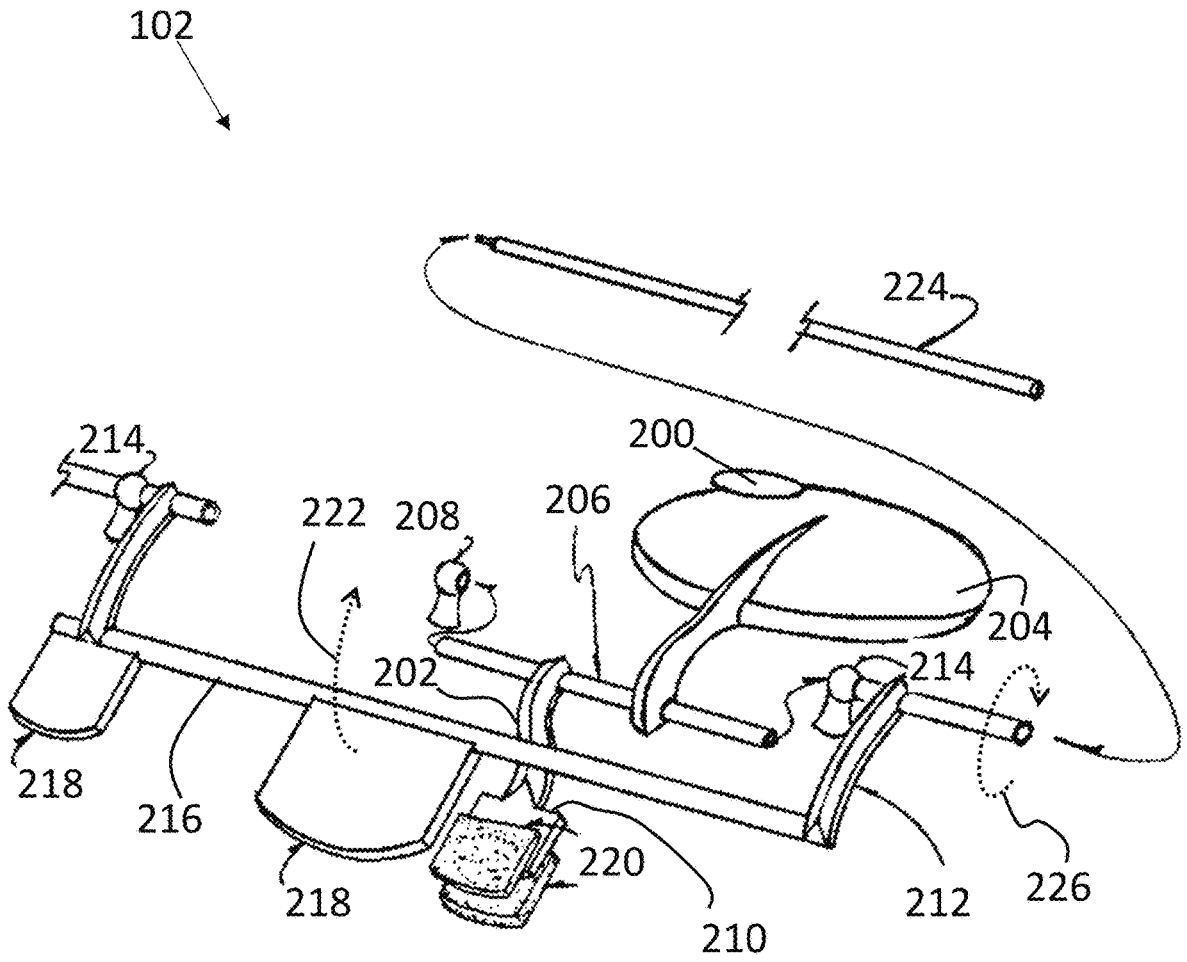
FIG. 2A is an exploded-view illustration of a bridged keywork mechanism according to various aspects of the present invention.

For further understanding, FIG. 2A provides an exploded-view illustration of a right-hand bridged keywork mechanism 102. Although depicting the right-hand mechanism 102, it should be understood that the features and functions as described and/or illustrated are equally applicable to the left-hand bridged keywork mechanism (albeit reversed as applicable). As shown, the bridged keywork mechanism 102 (or 104) includes a key. The key 204 is formed to cover and enclose a tone hole along the body of the saxophone to allow for various tones or sounds to be emitted by the saxophone. In order to operate the key 204, in some aspects, a button 200 is operably connected with the key 204. In some cases and as understood by those skilled in the art, the button 200 is directly connected to the key 204, whereas in other cases the button 200 is attached with a keywork mechanism which can be used to operate the key 204. In some aspects the key 204 is connected with an intermediate component (e.g., rod 206, etc.) that, in turn, is pivotally connected with a post 208 or other mechanism/device that allows for the key 204 to be selectively raised/lowered over a tone hole. Projecting from the rod 206 (or key in some aspects) is a tail 202 terminating in a kicker 210 that is formed to operably engage with a bridge 212. Thus, the key 204 is connected with a tail 202 that terminates in the kicker 210.

The bridge 212 is pivotally connected with posts 214 or other suitable components that allow the bridge 212 to be raised and lowered to connect with and operate one or more keys. The bridge 212 includes a bridge beam 216 spanning the length of the bridge 212. The bridge beam 216 includes one or more plates 218 extending therefrom. Notably, the plates 218 are positioned such that they lay above a kicker 210. Importantly and stated in the alternative, the kicker 210 projects beyond the bridge beam 216 such that it resides below the plates 218. This is important since extending the kicker 210 to beyond the bridge beam 216 allows the kicker 210 to operates as an extended lever to more easily lift the corresponding plate 218. The larger plates 218 and kickers 210 sit further away from the fulcrum point of the key, increasing the distance between the point of load and the point of effort as compared to conventional saxophone design, thereby rendering the key movement easier for the player. The present invention is to be contrasted with the prior art in which a tail is positioned directly below a bridge beam, resulting in less leverage and increased difficulty in raising the bridge beam (and thereby closing a corresponding key).

Adjustment pads 220 are attached with the kicker 210 to cushion the impact between the kicker 210 and a corresponding plate 218 (and saxophone body). In other words, the pads 220 can be affixed with the kicker 210 to sandwich the kicker 210 therebetween. The pads 220 are formed of any suitable cushioning material, non-limiting examples of which include compressed felt and cork. In some aspects, an axle 224 (e.g., steel, etc.) can be included that passes through a portion of the bridge 212 and rod 206 to affix the bridged keywork mechanism assembly together (via threading into the posts 214, etc., or using any other mechanism or device) and with the saxophone. Thus and as depicted, one or more individual keys 204 fit and reside within the bridge 214 such that depressing a button 200 (and forcing down a key 204) causes the kicker 210 to engage with a plate 218, thereby raising 222 the plate 218. Raising 222 the plate 218 causes the bridge 212 to rotate 226 and force another key (not shown) down to cover another tone hole. This aspect is further depicted in FIGS. 2B and 2C, depicting the right-hand and left-hand bridged keywork mechanisms, respectively.

Figure 2B:
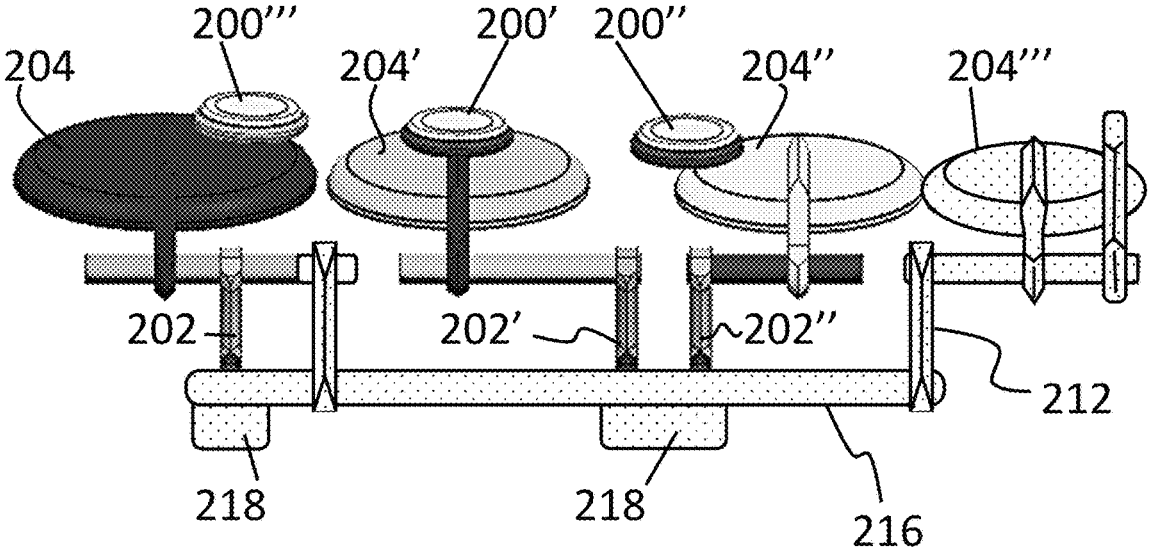
FIG. 2B is an illustration of a right-hand bridged keywork mechanism according to various aspects of the present invention.
Figure 2C:
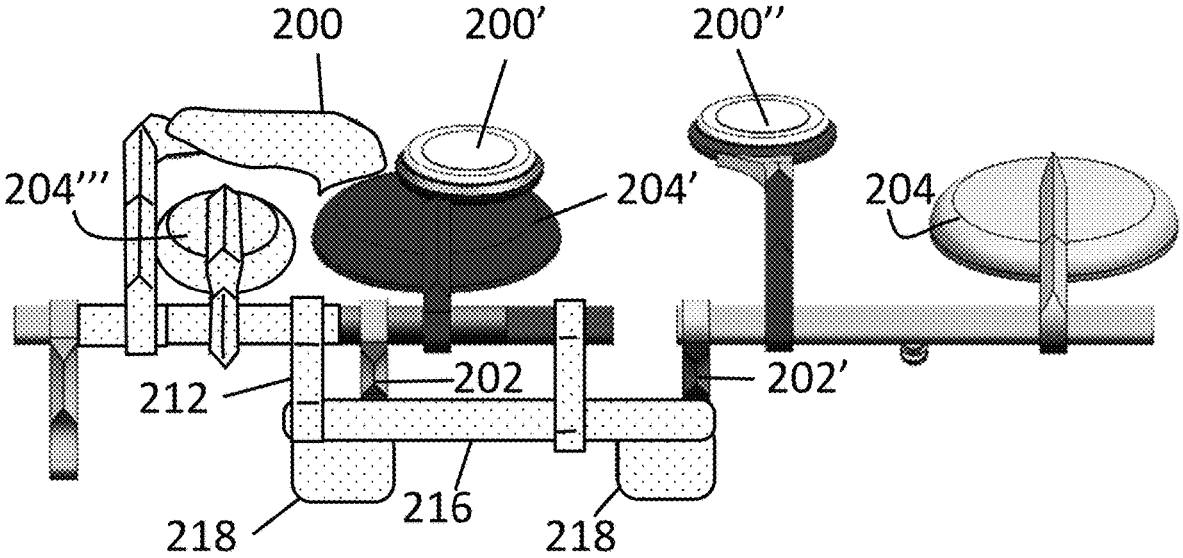
FIG. 2C is an illustration of a left-hand bridged keywork mechanism according to various aspects of the present invention.

As shown in both FIGS. 2B and 2C, the bridge 212 includes plates 218 projecting from the bridge beam 216. Positioned under each plate 218 are the kickers (not shown as they are obscured by the plates 218), each of which is connected with a corresponding key 204, 204', 204" and 204'". While the kickers are not depicted in FIGS. 2B and 2C, the various tails 202, 202' and 202" are shown, which given the description above and illustrations provided herewith, one skilled in the art can understand how depressing any of the buttons 200', 200" and 200'" would activate the bridged keywork mechanism. For example, depressing any of buttons 200', 200", or 200'" would cause the corresponding kicker to lift up the associated plate. In doing so, the bridge 212 would pivot upwards to force down key 204'" (which is connected with the bridge 212). Thus, in one specific example, activating a first key 204' (by depressing button 200') causes the corresponding kicker to lift the bridge beam 216 and thereby activate a second key 204'" (i.e., forcing the second key 204'" down over the tone hole).

Figure 3A:
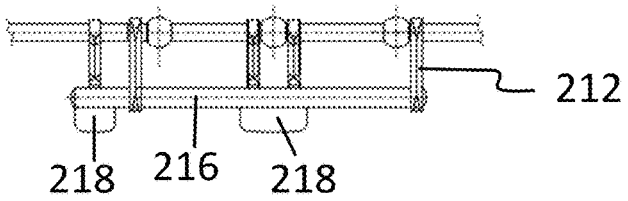
FIG. 3A of a top-view illustration of the right-hand bridged keywork mechanism according to various aspects of the present invention.
Figure 3B:
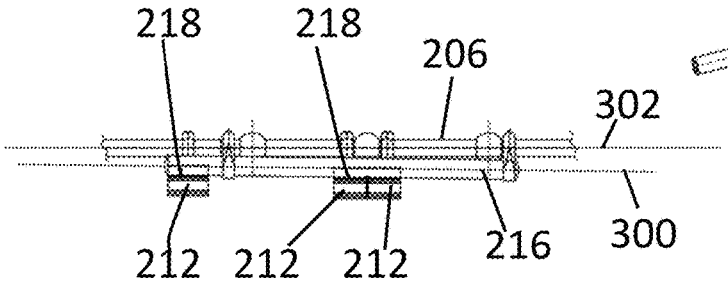
FIG. 3B is a front-view illustration of the right-hand bridged keywork mechanism according to various aspects of the present invention.
Figure 3C:
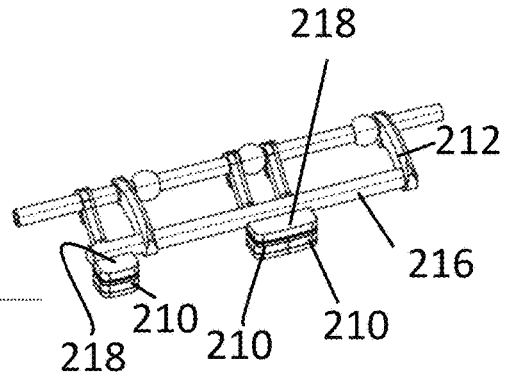
FIG. 3C is an elevated-view illustration of the right-hand bridged keywork mechanism according to various aspects of the present invention.
Figure 4A:
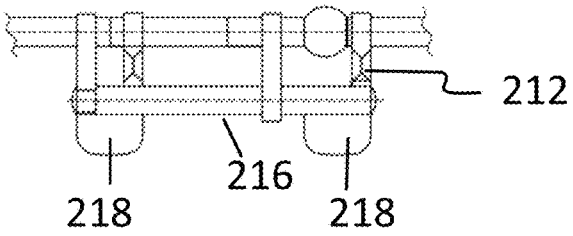
FIG. 4A of a top-view illustration of the left-hand bridged keywork mechanism according to various aspects of the present invention.
Figure 4B:
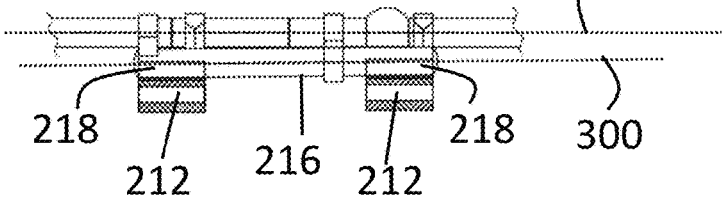
FIG. 4B is a front-view illustration of the left-hand bridged keywork mechanism according to various aspects of the present invention.
Figure 4C:
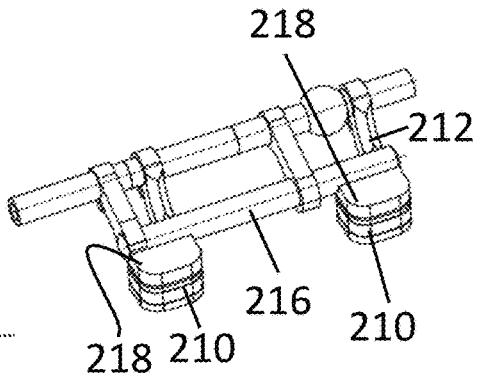
FIG. 4C is an elevated-view illustration of the left-hand bridged keywork mechanism according to various aspects of the present invention.

For further understanding, FIGS. 3A through 3C depict a top-view, front-view, and elevated-view, respectively, of the right-hand bridged keywork mechanism 102, while FIGS. 4A through 4C, which depict a top-view, front-view, and elevated-view, respectively, of the left-hand bridged keywork mechanism 104. As shown, the bridge 212 includes a bridge beam 216 with plates 218 projecting therefrom. Positioned beneath the plates 218 are the various kickers 210 (each of which is connected with a button and/or key (not shown) via a tail).

It should be noted that in some aspects the bridge 212 is optimally designed to work with the conical shaped body of the saxophone. While a flute has a cylindrical body, a saxophone has a conical or tapered shape body. Thus, in some aspects, the plates 218 and kickers 210 are designed such that they are not all in the same plane, following instead the tapered body of the saxophone. This aspect is depicted in FIGS. 3C and 4C, which depict the bridge beam 216 as being skew (i.e., not parallel) with the rod 206 that holds one or more keys. In other words, the axes 300 and 302 passing between the bridge beam 216 and rod 206, respectively, are desirably not parallel with one another. In some aspects and because of this, the various plates 218 are in distinct planes with respect to one another. It should be understood that although the axes 300 and 302 are desirably skew, the invention is not intended to be limited thereto. It should also be noted that, desirably, the bridge 212 is pivotally connected with the saxophone such that the bridge 212 and rod 206 share the same first axis 302.

Figure 5:
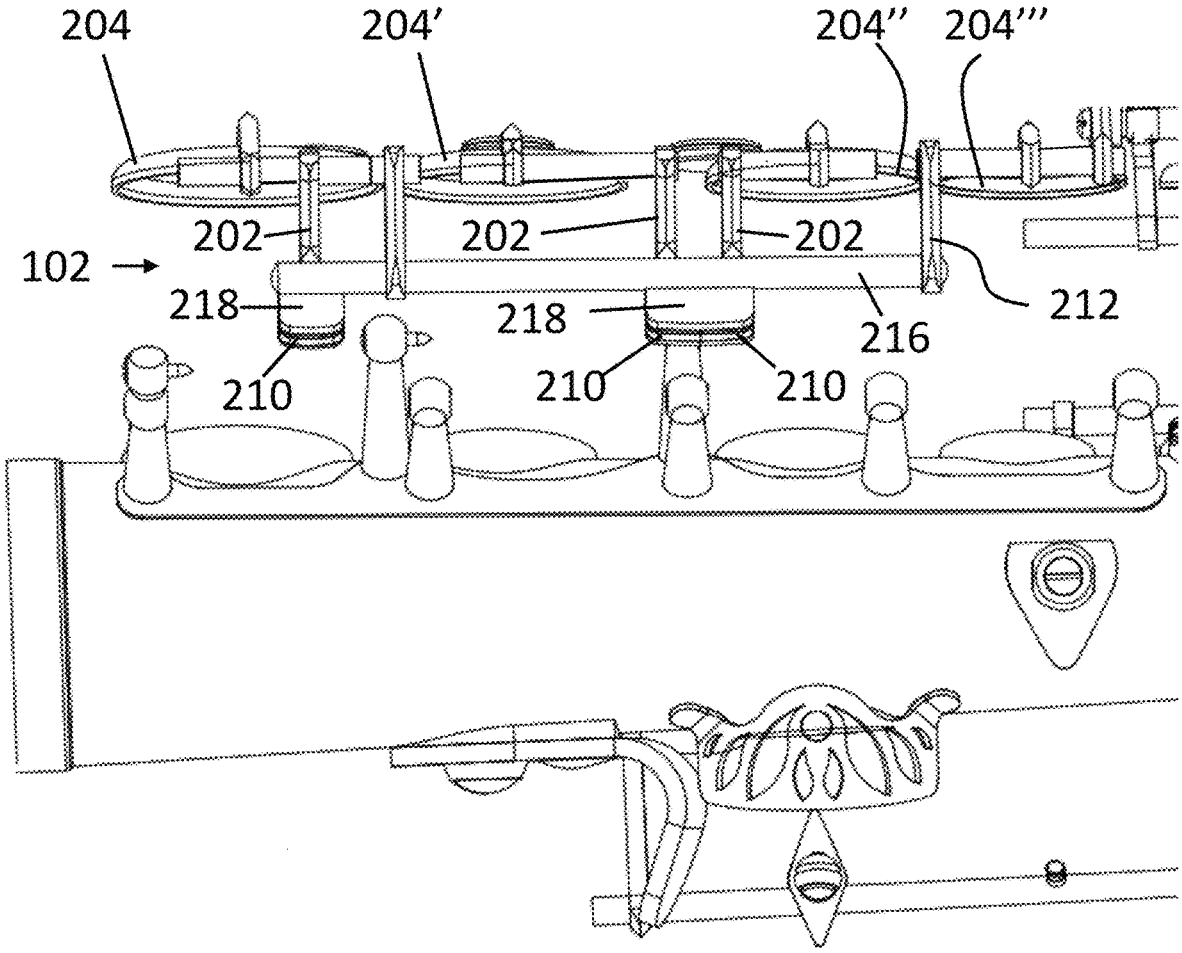
FIG. 5 is an illustration depicting placement of the right-hand bridged keywork mechanism according to various aspects of the present invention.
Figure 6:
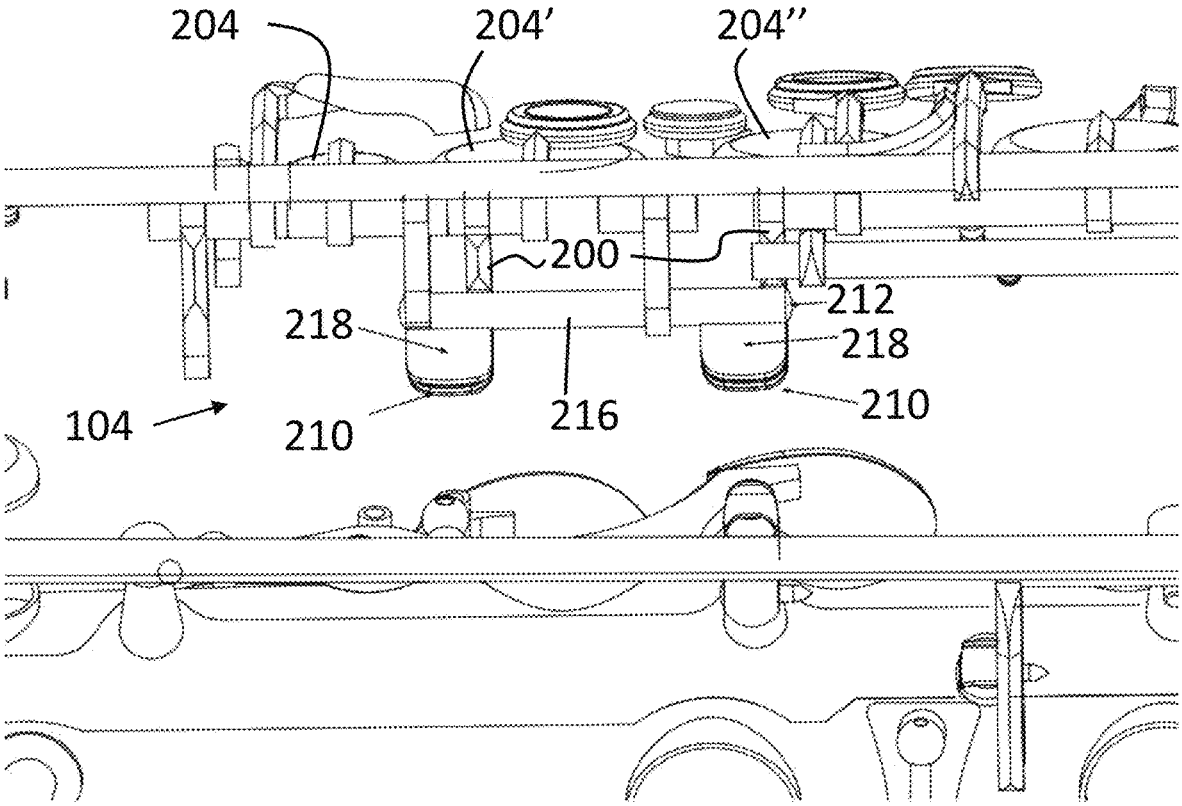
FIG. 6 is an illustration depicting placement of the left-hand bridged keywork mechanism according to various aspects of the present invention.

For further understanding, FIGS. 5 and 6 depict partial assembly and placement of the right-hand bridged keywork mechanism 102 and the left-hand bridged keywork mechanism 104, respectively. As shown, each of the right-hand and left-hand bridged keywork mechanisms 102 and 104 include the bridge 212 with bridge beam 216. Projecting from the bridge beams 216 are the plates 218 that reside above the kickers 210, which are in turn operably (via the tails 202, etc.) connected with the various keys 204, etc.

Figure 7:
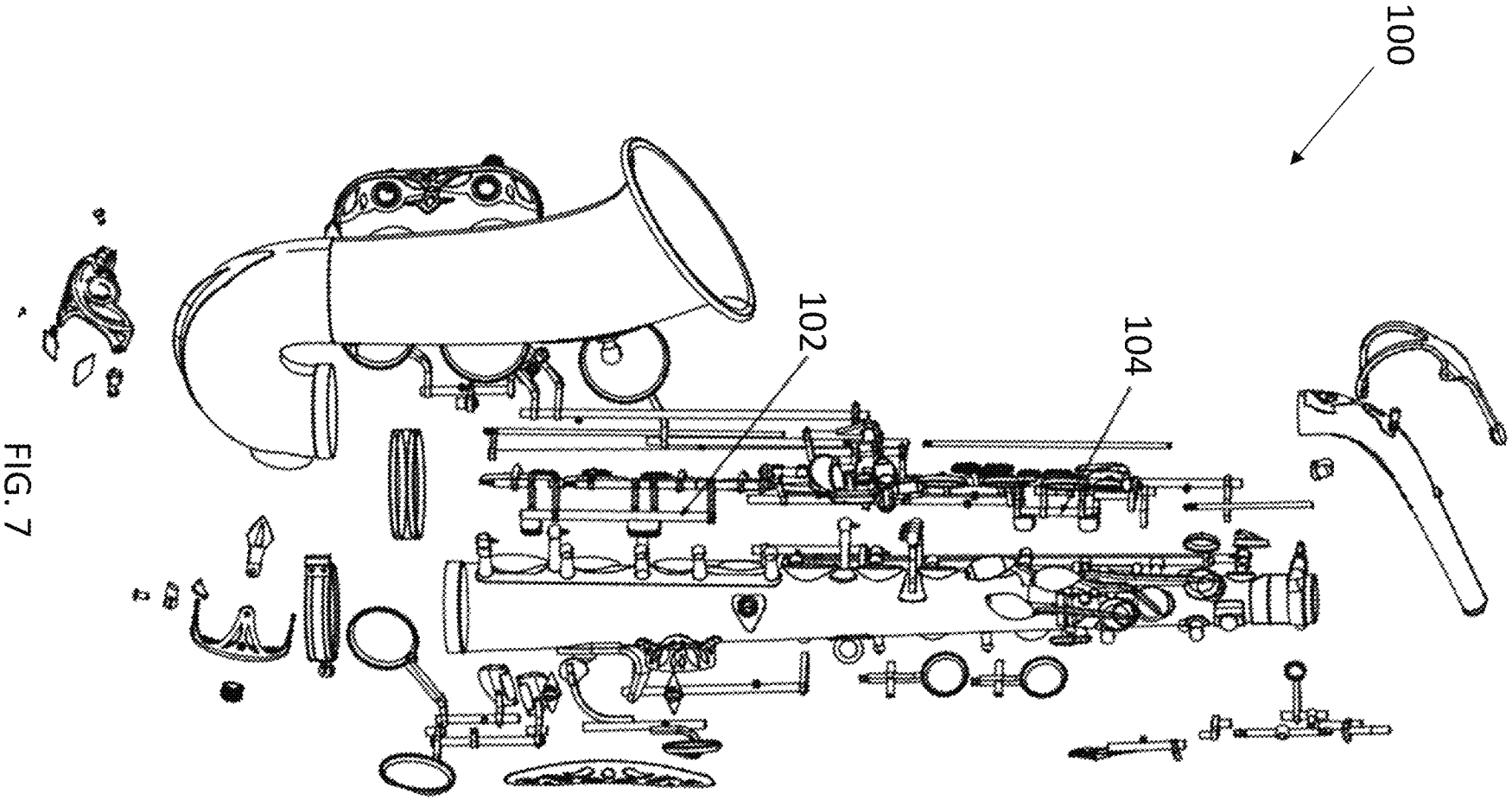
FIG. 7 is an exploded, left, side-view illustration of the saxophone according to various aspects of the present invention.
Figure 8:
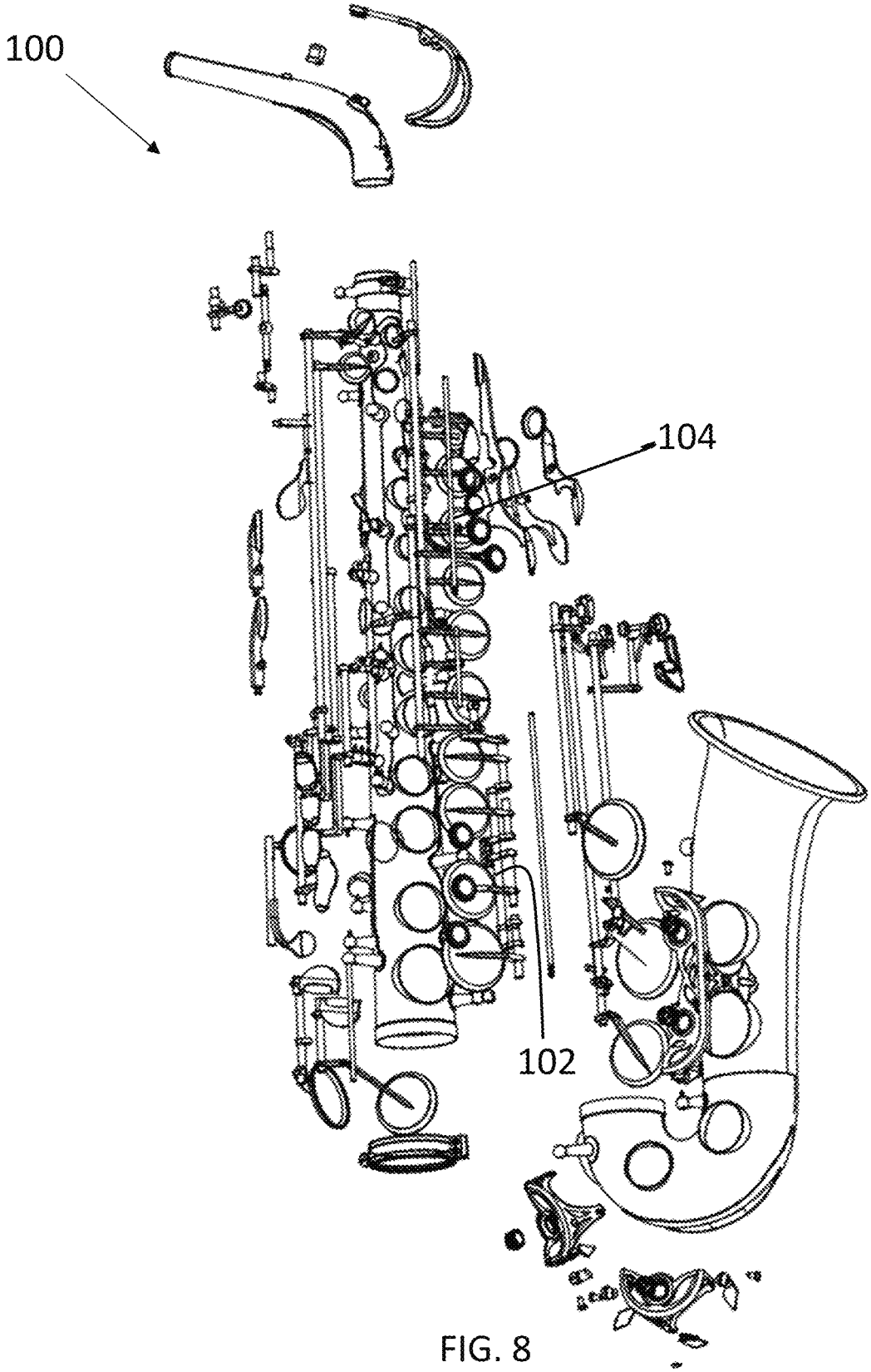
FIG. 8 is an exploded, right, side-view illustration of the saxophone according to various aspects of the present invention.

It should be noted that the bridged keywork mechanisms 102 and 104 can be positioned at any desired location in a saxophone 100. Desirably, the left-hand bridged keywork mechanism 104 is placed to operate the upper section of keys closest to the saxophone mouthpiece. It includes the keys which are operated by the left hand of the player. Alternatively, the right-hand bridged keywork mechanism 102 is placed such that it operates the lower section of keys closest to the bell. It includes the keys which are operated by the right hand of the player. For further understanding, FIGS. 7 and 8 provide exploded left and right views, respectively, of the saxophone 100 and corresponding bridged keywork mechanisms 102 and 104.

As can be appreciated by those skilled in art, the bridged keywork mechanism described herein provides several advantages over the prior art. For example, bridged keywork in the prior art never included plates or kickers. Through use of the plates and kickers, the there is an increased contact area between the plate and kicker (as opposed to the tail only contacting the bridge beam as in the prior art). Extending the plate and corresponding kicker to contact one another beyond the bridge beam provides an increased leverage point to allow for ease of use in operating multiple keys. Further, the adjustment pads (such as cork) can be sanded to allow an operator to easily adjust the spacing between the kicker and the plate and/or saxophone body.

While bridged keywork is in used on handmade flutes, the keywork as it exists on handmade flutes is not suitable for a saxophone. The present invention substantially departs from the conventional concepts and designs of prior art for at least the following reasons. The traditional flute has a cylindrical body shape, resulting in the keywork of a traditional flute being made in a parallel, horizontal, linear orientation, with all components being on the same plane following the non-tapered body. Further, the traditional saxophone has a conical shaped body. This results in the bridge keywork having to be completely redesigned to exist in a non-parallel non-linear orientation. In the present invention, the inclusion of the plates and kickers are designed so that they are not on the same plane, following instead the tapered body of the saxophone.

The traditional flute has two connected, inline bridged key sections, the right hand and left-hand sections. These are separated at about the halfway point along the cylindrical body by a post. This results in the two bridged mechanisms having a connection point at about the halfway point on the instrument. This connection is an unstable transition point between the two sections, having to span the entire length of the keyed sections. Alternatively, the traditional saxophone has two separate bridged sections, the right-hand and left-hand bridged keywork mechanism. These right-hand and left-hand bridged keywork mechanisms are offset to one another, not inline. This necessitated the bridges to be newly designed as compared to the flute, as not to connect at the halfway point on the instrument. Thus, in the present invention, the right-hand and left-hand bridged keywork mechanisms are separated. These relatively shorter (in relationship to the instrument) and separated bridged keywork mechanisms of the present invention provide for a more stable mechanical condition.

Further, in the present invention, the connection between the two sections on the saxophone mechanism is made independently of the bridges, simplifying and adding stability. These separated bridge sections also allow for this mechanism to be adapted to the complete saxophone line successfully. Alternatively, the traditional flute mechanism, as it exists, with its connected, inline bridges would be unsuitable for the larger spans of distance along the saxophone body required in the entire saxophone family.

Thus, the present invention is directed to a mechanical bridged keywork mechanism for a saxophone, having large, flat, top plates attached to a bridge, and large, flat, kickers attached to the keys. It also has adjustment pads (compressed felt or cork) acting as the contact surface between the bridges and the keys. This large, flat contact surface between the bridges and keys and its use of adjustment pad material, provides for a more stable, faster, and quieter saxophone key mechanism. This type of bridge/large plate/large kicker system has never been applied to the saxophone. It also provides for an increased facility in the manufacture of the saxophone by allowing the technician easier access to the increased surface areas of the compressed felt (or cork) pad adjustment materials, thereby rendering the adjustment procedure less difficult and more stable.

Finally, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means". Further, while particular method steps have been recited in a particular order, the method steps may occur in any desired order and fall within the scope of the present invention.

What is claimed is:

1. A bridged keywork mechanism for a saxophone, comprising:

a first key having a first tail terminating in a first kicker, the first key being pivotally connected with the saxophone to pivot about a first axis;

a first bridge having a first bridge beam spanning a length of the first bridge, the first bridge being pivotally connected with the saxophone;

a second key attached with the first bridge;

one or more first plates projecting outward from the first bridge beam, wherein the first key is pivotally attached with the saxophone such that the first kicker resides below the one or more first plates, whereby activating the first key causes the first kicker to lift the first bridge beam and thereby activate the second key.

2. The bridged keywork mechanism for a saxophone as set forth in claim 1, wherein the first bridge is pivotally connected with the saxophone to pivot about the first axis, and wherein the first bridge beam has a second axis passing through the first bridge beam such that the first axis and the second axis are skew with respect to one another.

3. The bridged keywork mechanism for a saxophone as set forth in claim 2, wherein the one or more first plates project from the first bridge beam such that each plate in the one or more first plates lays in a distinct plane.

4. The bridged keywork mechanism for a saxophone as set forth in claim 3, further comprising a set of adjustment pads connected with the first kicker to sandwich the first kicker therebetween.

5. The bridged keywork mechanism for a saxophone as set forth in claim 4, wherein the first key, first bridge, and second key collectively form a right-hand bridged keywork mechanism.

6. The bridged keywork mechanism for a saxophone as set forth in claim 5, further comprising:

a third key having a third tail terminating in a third kicker, the third key being pivotally connected with the saxophone;

a second bridge having a second bridge beam spanning a length of the second bridge, the second bridge being pivotally connected with the saxophone;

a fourth key attached with the second bridge;

one or more second plates projecting outward from the second bridge beam, wherein the third key is pivotally attached with the saxophone such that the third kicker resides below the one or more second plates, whereby activating the third key causes the third kicker to lift the second bridge beam and thereby activate the fourth key.

7. The bridged keywork mechanism for a saxophone as set forth in claim 6, wherein the third key, second bridge, and fourth key collectively form a left-hand bridged keywork mechanism, wherein each of the right-hand bridged mechanism and left-hand bridged keywork mechanism are connected with the saxophone such that they are offset from one another around the body of the saxophone.

8. The bridged keywork mechanism for a saxophone as set forth in claim 1, wherein the one or more first plates project from the first bridge beam such that each plate in the one or more first plates lays in a distinct plane.

9. The bridged keywork mechanism for a saxophone as set forth in claim 1, further comprising a set of adjustment pads connected with the first kicker to sandwich the first kicker therebetween.

10. The bridged keywork mechanism for a saxophone as set forth in claim 1, further comprising:

a third key having a third tail terminating in a third kicker, the third key being pivotally connected with the saxophone;

a second bridge having a second bridge beam spanning a length of the second bridge, the second bridge being pivotally connected with the saxophone;

a fourth key attached with the second bridge;

one or more second plates projecting outward from the second bridge beam, wherein the third key is pivotally attached with the saxophone such that the third kicker resides below the one or more second plates, whereby activating the third key causes the third kicker to lift the second bridge beam and thereby activate the fourth key.

11. The bridged keywork mechanism for a saxophone as set forth in claim 10, wherein the first key, first bridge, and second key collectively form a right-hand bridged keywork mechanism, and wherein the third key, second bridge, and fourth key collectively form a left-hand bridged keywork mechanism, such that each of the right-hand bridged mechanism and left-hand bridged keywork mechanism are connected with the saxophone such that they are offset from one another around the body of the saxophone.

* * * * *